US005824942A

United States Patent [19]

Mladjan et al.

[11] Patent Number: 5,824,942

[45] Date of Patent: Oct. 20, 1998

[54] METHOD AND DEVICE FOR FIRE CONTROL OF A HIGH APOGEE TRAJECTORY WEAPON

[75] Inventors: Gary J. Mladjan, Torrance; Douglas A. Anderson, Long Beach; Clarence E. Dickson, Hawthorne, all of Calif.

[73] Assignee: Raytheon Company, El Segundo, Calif.

[21] Appl. No.: 589,810

[22] Filed: Jan. 22, 1996

[51] Int. Cl.[6] ..... F41G 3/06

[52] U.S. Cl. ..... 89/41.17; 42/103; 42/105

[58] Field of Search ..... 89/41.17, 41.19, 89/41.06; 42/103, 105

[56] References Cited

U.S. PATENT DOCUMENTS

| | | | |
|---|---|---|---|
| 3,733,465 | 5/1973 | Marasco | 89/41.06 |
| 3,824,699 | 7/1974 | Lenz et al. | 89/41.17 |
| 4,695,161 | 9/1987 | Reed | 42/103 |
| 5,171,933 | 12/1992 | Eldering | 89/41.06 |
| 5,208,417 | 5/1993 | Langer et al. | 89/41.06 |
| 5,568,152 | 10/1996 | Janky et al. | 89/41.17 |

*Primary Examiner*—Stephen M. Johnson
*Attorney, Agent, or Firm*—Leonard A. Alkov; William C. Schubert; Glenn H. Lenzen, Jr.

[57] ABSTRACT

The present invention relates to an improved method and device for aiming and firing a rifle-mounted grenade launcher without having to approximate the range of a target and then manually adjust the position of subsequently fired grenades. The grenadier initiates the process by pointing the grenade launcher at the target. The range and azimuth of the target are determined by a microprocessor controlled laser range finder/digital compass combination. A ballistic solution is calculated by the microprocessor and the superelevation required to place the grenade on target is displayed on one of several video displays. The grenadier then uses the vertical angle measurement capability of the laser range finder/digital compass assembly to rotate the grenade launcher to the proper angle while maintaining the proper azimuth. The grenade is then fired on target. The present method and associated hardware may be used as one component of a fully integrated, multi-functional, soldier-centered, computer-enhanced warfare system.

17 Claims, 2 Drawing Sheets

METHOD AND DEVICE FOR FIRE CONTROL OF A HIGH APOGEE TRAJECTORY WEAPON

BACKGROUND OF THE INVENTION

The present invention relates generally to a method of fire control for a weapon requiring a high apogee trajectory for successfully engaging a target with an ordnance round. More specifically, the present invention relates to a device and an improved method of computer controlled firing of a grenade launcher which may used as one component of a larger comprehensive warfare system.

Modern technology, especially computers and electronics, have advanced rapidly in the recent past. It is only logical that these technological advances would be applied to the art of war, specifically to weapons and other equipment designed to make the modern soldier a more efficient fighting machine.

In pursuit of a more efficient fighting machine, a fully integrated, multi-functional, soldier-centered, computer enhanced, warfare system, aka the "Land Warrior" system ("LW"), has been developed. The LW system may be "worn" by a soldier during day-to-day military operations. It includes: improvements in communications, including three separate radios carried by the user; an "on-board" microprocessor for battle operations, navigation, and messaging; night vision equipment, including infrared and thermal weapon sighting; improved weaponry, including computer enhanced fire control; ballistic protection, including advanced body armor; and, load carrying capability, including a fully adjustable modular pack system. Features such as these provide the individual soldier with enhanced lethality, command and control, survivability, mobility, and sustainment.

Such an LW system is typically broken up into various sub-systems, each subsystem consisting of similar or related hardware which is dedicated to accomplishing a certain task or family of tasks. The LW system is composed of five such subsystems: (1) Computer/Radio Subsystem ("CRS"); (2) Weapon Subsystem ("WS"); (3) Integrated Helmet Assembly Subsystem ("IHAS"); (4) Protective Clothing and Individual Equipment Subsystem ("PCIES"); and, (5) LW Software Subsystem ("SS").

With regard to weapons in general, the M16 (also known as the Colt AR-15, from Colt Industries) is the standard weapon issued to virtually all U.S. Army combat personnel. It is a lightweight, durable rifle capable of firing 5.56 millimeter rounds in the semi-automatic or fully automatic mode. The M16 makes up the core of the LW Weapon Subsystem. In order to increase the flexibility and firepower of the M16, a grenade launcher may be attached. The standard U.S. Army issue grenade launcher (designated by the military as the M203) is mounted directly under the barrel of the M16 and is usually carried by several members of a military contingent. The grenade launcher provides a variety of long range attack options (using various types of grenades) combined with the mobility of a portable weapon.

In the past, aiming a grenade launcher has not been a study in precision ballistics. An ordnance round such as a shoulder-fired grenade usually needs a very high apogee trajectory to reach a distant target. The firing angle required to accomplish this high apogee trajectory is known as a superelevation angle. Normally, the M203 employs an iron sight for aiming. The grenadier must estimate the range to the target and then set the sight for the proper range. A first grenade is launched and the impact is observed by the grenadier or other personnel. The sight is then manually adjusted based on the location of the impact of the first grenade and a second grenade is fired. This process, known in artillery jargon as "walking in" rounds, is repeated until the target is successfully engaged.

The disadvantages of "walking in" rounds to successfully engage a target are obvious. First, crucial time may be lost which could result in the disruption of precisely timed battle plans. Furthermore, the target may have time to move or return fire before it is eliminated, thus creating unnecessary risk for the grenadier and his comrades. Second, valuable ammunition is wasted merely determining the accurate range of the target.

In the recent past, improvements in laser technology have improved the way in which weapons are used. First, laser range finders are used to accurately determine the distance from a shooter to a target by reflecting a laser pulse off the target. It can be seen, then, that for weapons needing an accurate range to successfully engage a target, laser technology can improve the overall efficiency of a weapon. Second, laser sights enable a shooter to eliminate the error involved when a human eye is required to look some distance through several pieces of metal (the sight) to aim a short range weapon, such as a handgun. By providing a pinpoint, error-free aim point, laser technology can also improve the overall efficiency of a short range weapon.

Currently, there is no commercially available device known which uses laser technology to improve the efficiency of weapons requiring a high apogee trajectory, such as a grenade launcher, to successfully engage a target. Even if a grenadier used a precision range finding device such as a laser range finder, there would still be a large potential for human error. First, the grenadier would need to determine the firing angle of the grenade launcher and then maintain the angle while firing the grenade. Furthermore, the grenadier would need to sight through the fixed iron sight to maintain the proper azimuth to engage the target. To achieve both of these tasks while firing from a relatively unstable position, i.e., the shoulder, would be difficult at best.

SUMMARY OF THE INVENTION

The device and improved method of fire control for a grenade launcher of the present invention overcomes the problems experienced in the past when the standard iron sight of the grenade launcher was used, regardless of the method used to determine the range of the target. The method and device of the present invention utilize precise laser range finding techniques in combination with an advanced digital compass assembly and a microprocessor which together provide a substantial likelihood that the grenadier will successfully engage the target on the first shot. By eliminating the old method of walking in rounds, crucial time and valuable ammunition are conserved, thus improving the overall efficiency of the soldier.

The present method and device utilizes hardware from the Weapon Subsystem ("WS"), the Computer/Radio Subsystem ("CRS") and the Integrated Helmet Assembly Subsystem ("IHAS") of the abovedescribed Land Warrior system, as well as the Software Subsystem ("SS"), as further described herein. The WS provides the means of delivery (i.e., the M203 grenade launcher, typically mounted on an M16 rifle), and the aiming mechanism (the laser range finder/digital compass assembly). The CRS provides the computational ability necessary to calculate a ballistic solution given the range and proper azimuth of the target. The IHAS provides a video display which allows the grenadier to physically aim the grenade launcher and take advantage of the computer controlled fire control. Finally, the SS provides the means by which all other subsystems communicate with each other and also provides the mathematical capability to calculate a correct superelevation angle based on a given range of a target.

The actual method of fire control for the grenade launcher is as follows. The grenadier locates a target and actuates a laser range finder/digital compass assembly ("LRF/DCA") which is mounted on the M16/M203 combination. The LRF/DCA determines the range and proper azimuth of the target and provides them to a microprocessor (of the CRS) carried by the user. Using a preprogrammed look-up table, the microprocessor calculates a ballistic solution. That is, the microprocessor calculates the proper superelevation angle needed for the grenade to successfully engage the target and then displays it on an LED display of the LRF/DCA or on a video display of the IHAS. The grenadier uses the vertical angle measurement capability of the DCA to monitor the angle of the weapon as the weapon is lifted by the grenadier. When the display of the LRF/DCA indicates that the proper superelevation angle has been achieved, the grenadier maintains the weapon at the proper firing angle. After ensuring that the proper azimuth has been maintained, the grenadier may then fire the grenade launcher with the substantial likelihood that the target will be successfully engaged on the first shot.

The invention itself, together with further objects and attendant advantages, will be best understood by reference to the following detailed description, taken in conjunction with the accompanying drawings.

DETAILED DESCRIPTION

Figure 1:
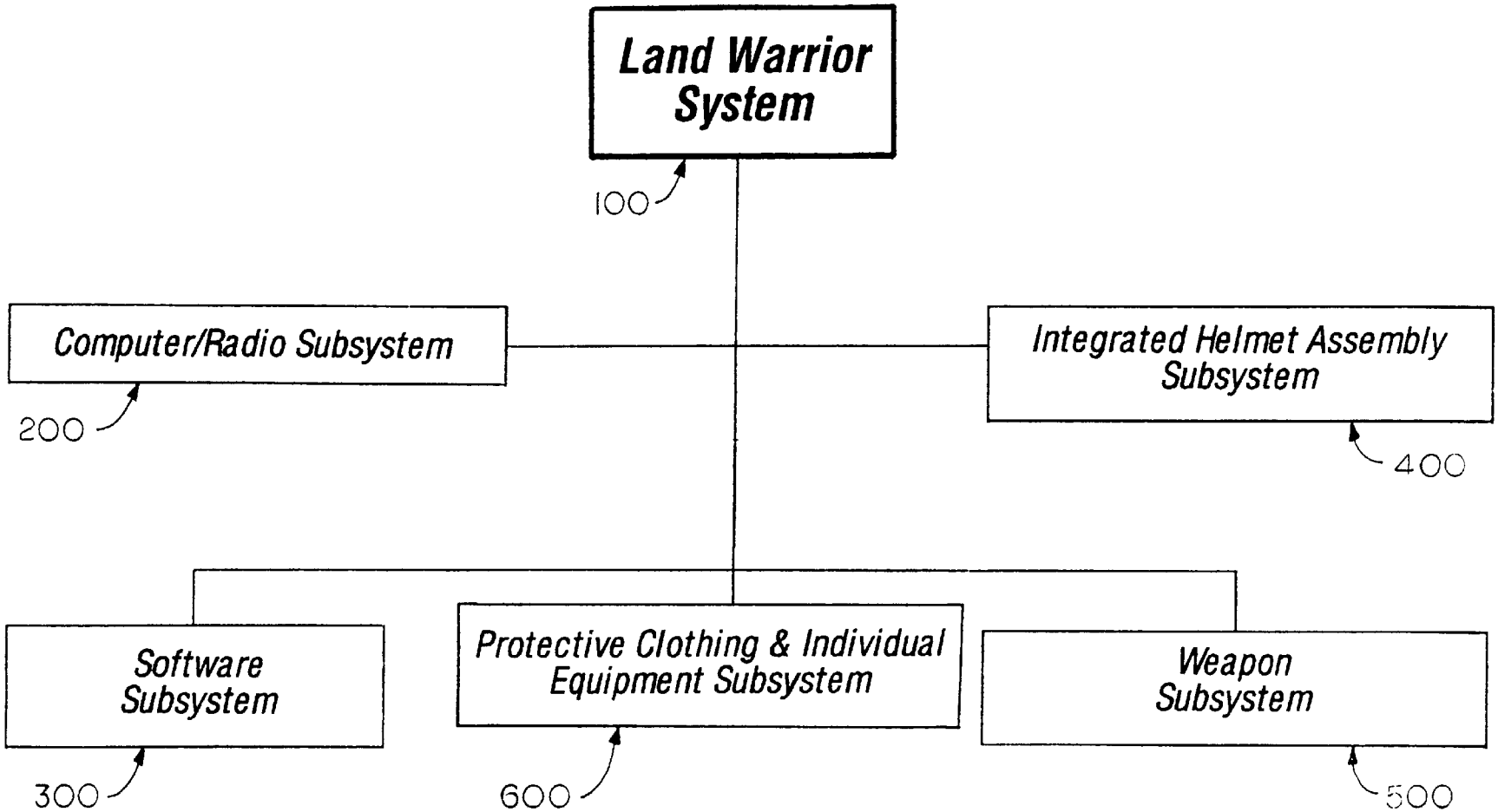
FIG. 1 is a block diagram of a warfare system which incorporates the method and the device of the present invention.

The overall structure of the warfare system which incorporates the method and device of the present invention is shown in FIG. 1. The LW system 100 includes five separate sub-systems: the Computer/Radio Subsystem ("CRS") 200; the Software Subsystem ("SS") 300; the Integrated Helmet Assembly Subsystem ("IHAS") 400; the Weapon Subsystem ("WS") 500; and, the Personal Clothing and Individual Equipment Subsystem ("PCIES") 600.

Figure 2:
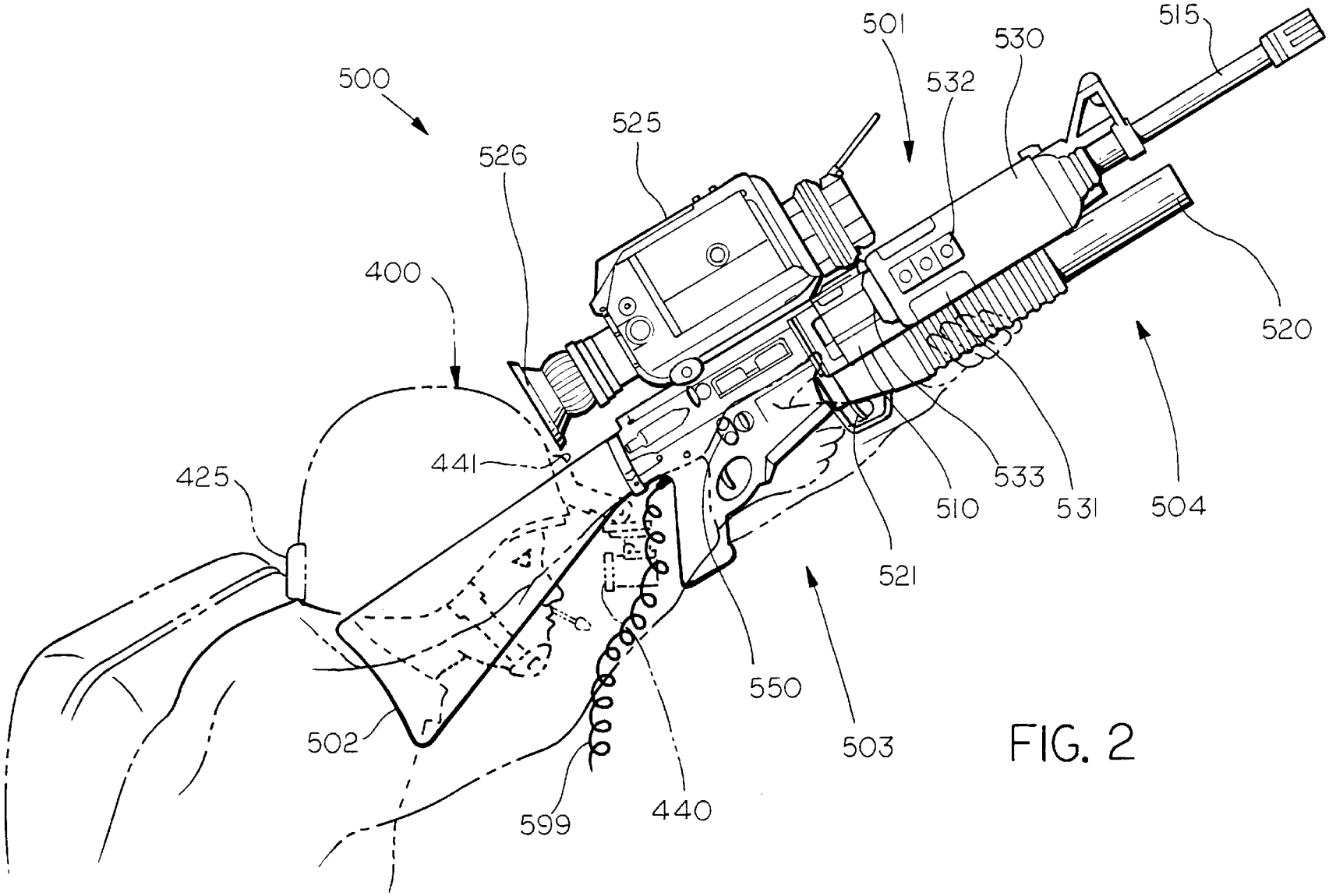
FIG. 2 is a elevational side view of the Weapon Subsystem and associated hardware used in the method and device of the present invention.

The method and device of the present invention primarily utilizes the hardware of the WS 500, best shown in FIG. 2. A standard, military issue M16 rifle 501 having a stock 502, a central section 503, and a forward section 504, forms the core of the WS 500. An M203 grenade launcher 520, also standard military issue, is mounted on the forward section 504 of the rifle 501 under hand guards 510 and barrel 515.

The LRF/DCA 530 is also mounted, using clamps (not shown), on the forward section 504 of the rifle 501, but to one side of hand guards 510. The laser range finder portion of the LRF/DCA 530 is a modified version of a commercially available mini-laser range finder developed by Fibertek for Night Vision Electronic Sensors Directorate. For the preferred embodiment of the present invention, the Fibertek packaging has been redesigned to improve the shock resistance of the LRF and to facilitate manufacturing. The laser is a flashlamp pumped Optical Parameter Oscillator ("OPO") shifted Yttrium Aluminum Garnet ("YAG") laser and is used to generate an eye safe, 5 nanosecond pulse having a wavelength of 1.57 micrometers. The laser pulse is transmitted through an integrated telescope (not shown), is reflected off a target (not shown), and is detected by an avalanche photodiode ("APD") to accurately determine the range of a target ±1 meter. As an added safety measure, a silicon filter blocks all non-eye safe wavelengths but passes the 1.57 micrometer wavelength (the laser actually emits a beam of light 1.06 micrometers in wavelength which is not eye safe at the power levels needed to meet the LW system requirements; the 1.06 micrometer wavelength light is converted to 1.57 micrometers and the unconverted light is blocked by the above-mentioned filter). An integral spotting light (not shown) provides a means for zeroing the invisible LRF beam to the bore of the rifle 501.

Integrated within the LRF/DCA 530 is the Digital Compass Assembly ("DCA"), not shown. The DCA is a commercially available MELIOS C/VAM supplied by Leica which is modified in accordance with the present invention. To achieve the vertical angle and azimuth accuracy needed, the calibration procedure is revised and the tilt sensors are slightly enlarged to respond up to the required ±45 degrees angle variation instead of the standard ±35 degrees angle variation (high apogee trajectory weapons achieve maximum distance when the firing angle is 45 degrees). Three solid-state magneto-resistive sensors are used to accurately transduce the earth's magnetic field in all battlefield environments. The DCA has an onboard microprocessor which translates the magneto-resistive sensor signals into azimuth and vertical angle readings.

A low power, high reliability LED display 533 is supplied as part of the LRF/DCA 530. The LED display 533 provides visual indicators which show mode status, alphanumeric readouts of range, azimuth, and vertical angle. The display 533 may contain a variable brightness control with an off position to maintain light security. The display 533 interfaces with and is controlled by the LRF/DCA microprocessor without additional support electronics.

The LRF/DCA 530 has two sets of controls. The set-up controls 531, which are simple membrane switches of conventional construction, are located on the outside of the LRF/DCA housing, slightly lower than a horizontal plane which extends through the longitudinal centerline of the LRF/DCA 530, best shown in FIG. 2. Functions of the set-up controls 531 may include turning the unit on and off, setting the operating mode, controlling video display, and providing backup for the remote CRS controls 550. The operations controls 532 are located above the set-up controls 531 on the housing of the LRF/DCA 530, also shown in FIG. 2. Functions of the operations controls 532 may include firing the laser, turning on a spotting light (not shown), selecting the M203 mode, and providing backup for the remote CRS controls 550 further described herein.

Another video display 440 which the grenadier can use to take advantage of the computer controlled fire control is the Sensor Display Assembly (not shown) of the IHAS 400. The specific configuration of the display is different for day and night missions. A standard helmet mount 441 allows either a day 440 or night component (not shown) to be attached. The attachment is similar to a standard night vision goggle mount (not shown) and allows adjustments of the display 440 in up/down, right/left, fore/aft, and tilt motions. The Night Sensor/Display Component ("NSDC") (not shown) is worn as a monocular night vision goggle which is positioned over the chosen eye. The day component 440 is also monocular, but can be placed in a variety of positions: a "look-under" mode (where the grenadier can see the display 440 but can also look under it); a see-through display mode (where the grenadier looks at a partially transparent display, allowing vision through the display 440); or a fully occluded mode (where the grenadier looks at the display 440 only and cannot see under or through the display 440).

The remote CRS controls 550 are mounted on the side of the central section 503 of the rifle 501 and are electrically connected to the microprocessor of the CRS 200. The remote CRS controls 550 allow the user to select the video display (440 or 533) where the video information will appear. The electronics (power and control) of the WS 500 are wired to the CRS 200 via external cable 599.

The method of fire control for the M203 grenade launcher 520 is as follows. It is assumed that the grenadier is at the ready, the LRF/DCA 530 has been activated using set-up controls 531, and a grenade is loaded into the launcher 520. The grenadier locates a target and selects the M203 mode by depressing the proper button on the operations controls 532. The grenadier points the LRF/DCA 530 at the target and then "fires" the laser beam of the LRF/DCA 530, also controlled by the operations controls 532. The LRF/DCA 530 determines the range and provides it either to the microprocessor (not shown) of the CRS 200 or to the microprocessor of the LRF/DCA 530. Using a pre-programmed look-up table, one of the microprocessors calculates a ballistic solution. That is, the microprocessor (not shown) calculates the proper superelevation angle needed for the grenade to successfully engage the target and then displays it on the selected video display: either on the LED display 533 of the LRF/DCA 530 or on the day component 440 of the Sensor Display Assembly (during the day) or on the night component NSDC (not shown) located on the IHAS 400. The proper superelevation angle appears as a negative angle on the selected video display 440 or 533. As the LRF/DCA 530 determines the range of the target, the azimuth is set to zero and is also displayed on the selected video display. For example, if the proper superelevation angle for target engagement was 45 degrees above horizontal, then the information appearing on the selected video display would be "AZ: 0000m" and "MILS VERT: −45m". As the grenadier raises the muzzle of the weapon, the tilt sensors (not shown) of the LRF/DCA 530 allow the angle of the grenade launcher 520 to be monitored: the selected video display 440 or 533 reflects the gradually changing angle from −45 degrees to 0 degrees. When the display reads 0 degrees superelevation and the proper azimuth of 0 degrees, the weapon is on target (any straying off the correct azimuth would be indicated on the selected display by some angle other than 0 degrees; to regain a proper fix on the target, the grenadier would merely swing the grenade launcher 520 in a direction so that the azimuth reading would return to zero). The grenade launcher 520 is then fired using trigger 521.

The method of fire control of the present invention is not limited to the M16 mounted M203 grenade launcher 520. It can also be used with any number of high apogee trajectory weapons, including the MK19 grenade machine gun and the like.

Of course, it should be understood that a wide range of changes and modifications can be made to the preferred embodiment described above. It is therefore intended that the foregoing detailed description be regarded as illustrative rather than limiting and that it be understood that it is the following claims, including all equivalents, which are intended to define the scope of the invention.

What is claimed is:

1. A device for delivering an ordnance round to a target, said device comprising:

a weapon;

a laser range finder/digital compass assembly, said laser range finder/digital compass assembly being mounted to said weapon, said laser range finder/digital compass assembly having a laser range finder portion and a digital compass portion;

a first microprocessor, said first microprocessor being in electrical communication with said laser range finder/digital compass assembly; and, a first video display, said first video display being in electrical communication with said laser range finder/digital compass assembly, said first video display further being in electrical communication with said first microprocessor.

2. The device according to claim 1 wherein said weapon comprises a high apogee trajectory weapon.

3. The device according to claim 1 wherein said weapon comprises a portable grenade launcher.

4. The device according to claim 1 wherein said laser range finder portion and said digital compass portion are integrated within a single housing.

5. The device according to claim 4 wherein said first video display is integrated within said single housing.

6. The device according to claim 4 further comprising a second microprocessor, said second microprocessor being integrated within said single housing, said second microprocessor being in electrical communication with said laser range finder/digital compass assembly.

7. The device according to claim 1 further comprising a second video display, said second video display being in electrical communication with said laser range finder/digital compass assembly, said second video display further being in electrical communication with said first microprocessor.

8. The device according to claim 7 further comprising a remote control, said remote control for switching between said first video display and said second video display.

9. The device according to claim 8 wherein said remote control is mounted on said weapon.

10. A device for delivering an ordnance round to a target, said device comprising:

a weapon;

a laser range finder, said laser range finder being mounted to said weapon;

a digital compass assembly, said digital compass assembly being mounted to said weapon;

means for computing a firing angle necessary for successful delivery of said ordnance round to said target said computing means being electrically connected to said laser range finder and said digital compass assembly; and, means for displaying information obtained by said laser range finder, said digital compass assembly, and said means for computing a firing angle, said displaying means being electrically connected to said laser range finder, said digital compass assembly, and said means for computing a firing angle.

11. The device according to claim 10 wherein said weapon comprises a portable grenade launcher.

12. The device according to claim 10 wherein said laser range finder and said digital compass assembly are integrated within a single housing.

13. The device according to claim 12 wherein said means for displaying information is integrated within said single housing.

14. The device according to claim 13 wherein said means for displaying information is remotely located from said single housing.

15. The device according to claim 13 wherein said means for displaying information is located on headgear worn by a user.

16. The device according to claim 10 wherein said means for computing a firing angle comprises a microprocessor.

17. The device according to claim 16 wherein said microprocessor is remote from a single housing.

* * * * *